US007510271B2

(12) United States Patent
Owaki et al.

(10) Patent No.: US 7,510,271 B2
(45) Date of Patent: Mar. 31, 2009

(54) LIQUID EJECTION HEAD

(75) Inventors: Hiroshige Owaki, Nagano (JP); Kazutoshi Goto, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 435 days.

(21) Appl. No.: 11/376,335

(22) Filed: Mar. 16, 2006

(65) Prior Publication Data

US 2006/0256159 A1 Nov. 16, 2006

(30) Foreign Application Priority Data

Mar. 16, 2005 (JP) ..... P2005-074720

(51) Int. Cl.
*B41J 2/045* (2006.01)

(52) U.S. Cl. ..... 347/68; 347/94

(58) Field of Classification Search ..... 347/20, 347/54, 63, 68, 70, 71, 49, 84–87, 94
See application file for complete search history.

(56) References Cited

U.S. PATENT DOCUMENTS 7,070,263 B2 * 7/2006 Okazawa ..... 347/68

FOREIGN PATENT DOCUMENTS

JP 2002-127407 A 5/2002
JP 2004-148509 A 5/2004

* cited by examiner

*Primary Examiner*—Juanita D Stephens
(74) *Attorney, Agent, or Firm*—Sughrue Mion, PLLC

(57) ABSTRACT

A liquid ejection head including: a head main body including: a cavity unit including a passage forming base plate forming a liquid passage from a common liquid chamber to a nozzle opening via a pressure chamber; and a pressure generating source generating a change of pressure of liquid in the pressure chamber to eject the liquid in the pressure chamber as a liquid droplet from the nozzle opening; and a case member to which the head main body is attached and which includes: a first member provided with a first atmosphere opening passage; and a second member laminated on the first member and provided with a second atmosphere opening passage, wherein the first and second atmosphere opening passages communicate with each other under the laminated state and are opened to atmosphere.

15 Claims, 5 Drawing Sheets

LIQUID EJECTION HEAD

BACKGROUND OF THE INVENTION

1. Technical Field of the Invention

The present invention relates to a liquid ejection head such as an ink jet type recording head, and more particularly to a liquid ejection head in which the evaporation of liquid in a liquid passage is suppressed and the viscosity of the liquid is prevented from rising.

2. Description of the Related Art

As a liquid ejection head for generating the variation of pressure in liquid in a pressure chamber to eject the liquid from nozzle openings as droplets, for instance, exemplified are an ink jet type recording head (simply refer it to as a recording head, hereinafter) used for an image recording device such as an ink jet type printer, a color material ejection head used for producing a color filter of a liquid crystal display or the like, an electrode material ejection head used for forming an electrode of an organic EL (Electro Luminescence), an FED (face light emitting display) or the like, a biological organic material ejection head used for producing a bio-chip (a biochemical element), etc.

As one example of the recording head, there is a recording head including a nozzle forming base plate on which rows of nozzles having a plurality of nozzle openings formed are arranged, a passage forming base plate for forming a consecutive passage from a common liquid chamber (reservoir) to the nozzle openings via a pressure chamber, a cavity unit having a seal plate for sealing the openings of the pressure chamber and the common liquid chamber, a piezoelectric element as a pressure generating source capable of generating the variation of pressure in ink in the pressure chamber and a case member to which the piezoelectric element and the cavity unit are attached.

The sealing plate is composed of a composite plate material formed by laminating a PPS (polyphenylene sulfide) resin film as an elastic thin film part on the surface of a metallic support plate such as stainless steel. In the sealing plate, a compliance part for sealing a part of the reservoir is provided. The compliance part is composed only of the elastic thin film part by removing the support plate of an area opposed to the opening surface of the reservoir by, for instance, an etching process. Then, the compliance part functions as a damper for absorbing the variation of pressure in the reservoir when the piezoelectric element is driven.

In the case member, in a part corresponding to the reservoir (the compliance part) on a connecting surface to the cavity unit, a relief recessed part is formed for allowing the deformation of the elastic thin film part due to the variation of pressure in the reservoir. Further, in the case member, atmosphere opening passages are provided through which the relief recessed part communicates with an external part of the head. The atmosphere opening passages are passages for air that allow air in the relief recessed part to be discharged outside or outside air to be introduced to the relief recessed part in accordance with the operation (the deformation of the elastic thin film part) of the compliance part.

When the recording head having the above-described structure is not continuously used for a long period of time, a solvent of ink in the reservoir gradually becomes steam and the steam passes through the elastic thin film and is discharged to an external part through the atmosphere opening passages. Thus, the viscosity of the ink may be possibly increased. The increased viscosity of the ink may possibly cause an inconvenience such as an insufficient discharge.

Thus, to prevent such an inconvenience, a recording head is proposed in which extremely narrow and small control passages that are set to such a passage resistance as to suppress the diffusion of steam are provided between a relief recessed part (a recessed part for a damper) and atmosphere opening passages to allow them to mutually communicate (for instance, see JP-A-2004-148509 (FIG. 4)). The control passage is set to have the transmittance of steam lower than the transmittance of steam of an elastic thin film part by increasing the passage resistance and the passage resistance of the control passage allows the diffusion of the steam of a solvent of ink in a reservoir to be suppressed, so that the viscosity of the ink is prevented from increasing.

In JP-A-2004-148509, the control passages are provided as grooves extending in the planar direction of the sealing plate in an area located outside the ink passages of the pressure chamber or the reservoir (the compliance part) on a connecting surface of the sealing plate to the case member. However, to ensure the length of the control passages necessary for completely exhibiting the transmitting characteristics of the steam, a surplus area for that purpose needs to be provided in the sealing plate. Therefore, the provision of the control passages in the sealing plate restrains the recording head from being miniaturized. Further, when the control passages are provided in a previously limited area, the necessary length of the control passages is hardly ensured.

Further, in the recording head having the above-described structure, a synthetic resin is ordinarily preferably used as a material of the case member in view of easy moldability. On the other hand, the sealing plate of the cavity unit connected to the case member is formed with metal such as stainless steel. Accordingly, a differential thermal expansion exists between these members and a stress is generated in the connecting part owing to the change of temperature or humidity, so that there is a fear that a distortion or separation may possibly arise between the members. Thus, as an adhesive agent for connecting the case member to the cavity unit (sealing plate), a silicon type adhesive agent is preferably employed. Since the silicon type adhesive agent exhibits a flexibility under a connected state, a stress generated in the connecting part can be absorbed and mitigated by the flexibility of the silicon type adhesive agent. Thus, the distortion or the separation between the members can be prevented.

However, in the case of the structure in which the control passages are formed on the connecting surface of the sealing plate to the case member as in JP-A-2004-148509, when the silicon type adhesive agent is used to connect the members respectively, since the adhesive agent has a relatively high fluidity, the adhesive agent may possibly enter the control passages to prevent the functions of the control passages. Therefore, in the invention disclosed in the Patent Document 1, a selectable connecting unit is limited to a connection by transferring, for instance, an epoxy based sheet type adhesive agent. However, the sheet type adhesive agent is not suitable for absorbing and mitigating the stress generated in the connecting part between the members in view of thickness or flexibility.

SUMMARY OF THE INVENTION

The present invention is proposed by considering the above-described circumstance, and it is an object of the present invention to provide a liquid ejection head that can meet a miniaturization by preventing the rise of the viscosity of liquid in a liquid passage.

A liquid ejection head of an embodiment of the present invention is proposed to achieve the above-described object.

The liquid ejection head comprises: a head main body including: a cavity unit having a passage forming base plate for forming a consecutive liquid passage from a common liquid chamber to nozzle openings via a pressure chamber; and a pressure generating source for generating the change of pressure in liquid in the pressure chamber to eject the liquid in the pressure chamber as liquid droplets from the nozzle openings; and a case member to which the head main body is attached, and is characterized in that the case member is formed by laminating a plurality of case forming members, the plurality of case forming members are respectively provided with atmosphere opening passages, the atmosphere opening passages respectively communicate consecutively under a state that the case forming members are laminated and are opened to atmospheric air.

According to this structure, since the atmosphere opening passages are respectively individually formed in the case forming members so as to consecutively mutually communicate under a state that the case forming members are laminated, the length themselves of the individual passages can be shortened. Thus, the passages can be respectively formed with high accuracy. That is, the length of the individual passages is shortened, so that for instance, when the case member is formed by using a synthetic resin, a pin for forming a space part as a passage can be restrained from bending or breaking. Further, when the case member is formed by a pressing work to a metal material such as stainless steel, the bending or buckling of a punch can be suppressed during forming the atmosphere opening passages. As a result, the atmosphere opening passages can be accurately and easily formed.

Further, in the above-described structure, it is preferable that the atmosphere opening passages are formed so as to pass through in the direction in which the case forming members are laminated and control passages the passage resistance of which is made to be higher than that of the atmosphere opening passages are desirably formed in boundary surfaces between the plurality of case forming members so that the atmosphere opening passages respectively mutually communicate through the control passages.

The sectional area of the atmosphere opening passage is preferably larger than the sectional area of the control passage.

In the above-described structure, it is preferable that the cavity unit further comprises a plate joining an opening surface of the common chamber, the plate including: an elastic thin film part having an elasticity; and a support plate for supporting the elastic thin film part, wherein an area opposed to the opening surface of the common liquid chamber is composed only of the elastic thin film part, a part of the surface of the case member connected to the cavity unit and corresponding to the elastic thin film part is provided with a relief recessed part that does not prevent the change of the pressure from being mitigated, and the atmosphere opening passages preferably communicate with the relief recessed part.

According to the above-described structure, the control passages whose passage resistance is made to be higher than that of the atmosphere opening passages are provided in the boundary surfaces between the case forming members so that the atmosphere opening passages respectively communicate through the control passages. Accordingly, the passage resistance of the control passages enables a quantity of passage of steam to be suppressed and the diffusion of the steam of the liquid from the elastic thin film part of the plate to be suppressed. Thus, the liquid of the common liquid chamber can be retrained from being discharged outside the head as the steam through the atmosphere opening passages. As a result, even when the liquid ejection head is not continuously used for a long period time, the rise of the viscosity of the liquid in the liquid passage can be suppressed as much as possible.

Further, since the control passages are provided in the boundary surfaces between the plurality of case forming members, the length or the sectional area, especially, the length of the control passages can be set substantially without depending on the form of the liquid passage of the common ink chamber or the size of the liquid ejection head so as to have the passage resistance capable of suppressing the diffusion of the steam. Therefore, the miniaturization of the liquid ejection head can be met.

Further, since the control passages are provided on the boundary surfaces between the case forming members, that is, the control passages are formed at positions separate from a boundary surface (the connecting surface) of the case member and the cavity unit, even when an adhesive agent having a high fluidity is used as a connecting unit for connecting the case member to the cavity unit, there is no fear that the adhesive agent enters the control passages to give a difficulty to the functions of the control passages. Accordingly, the number of choices of the connecting unit for connecting the case member to the cavity unit (the plate) can be increased. For instance, a silicon type adhesive agent having a high flexibility can be used as the connecting unit. When there is a differential thermal expansion between a material (for instance, a synthetic resin) of the case member and a material of the plate (for instance, metal) of the cavity unit, if the silicon type adhesive agent is used as the connecting unit for these members, a stress generated in the connecting part can be absorbed and mitigated by the flexibility of the silicon type adhesive agent. Thus, a distortion or separation between the members can be prevented.

In the above-described structure, the elastic thin film part is preferably composed of polyphenylene sulfide.

Further, in the above-described structure, the case forming members are respectively desirably connected by an adhesion. Otherwise, in one case forming member of the case forming members respectively, bosses protrude on a surface connected to the other case forming member, boss receiving parts into which the bosses are inserted are formed on the other case member and the bosses are desirably inserted into the boss receiving parts so that the case forming members are respectively connected.

DETAILED DESCRIPTION OF THE INVENTION

Now, a best mode for carrying out the present invention will be described below by referring to the accompanying drawings. In below-described embodiments, various kinds of limitations are made as preferable specific examples of the present invention. As long as there is no description that the present invention is especially limited in the following explanation, the scope of the present invention is not limited to these embodiments. Further, in the following description, as a liquid ejection head of the present invention, an ink jet type recording head (refer it simply to as a recording head, hereinafter) mounted on an ink jet recording device will be described as an example.

Figure 1:
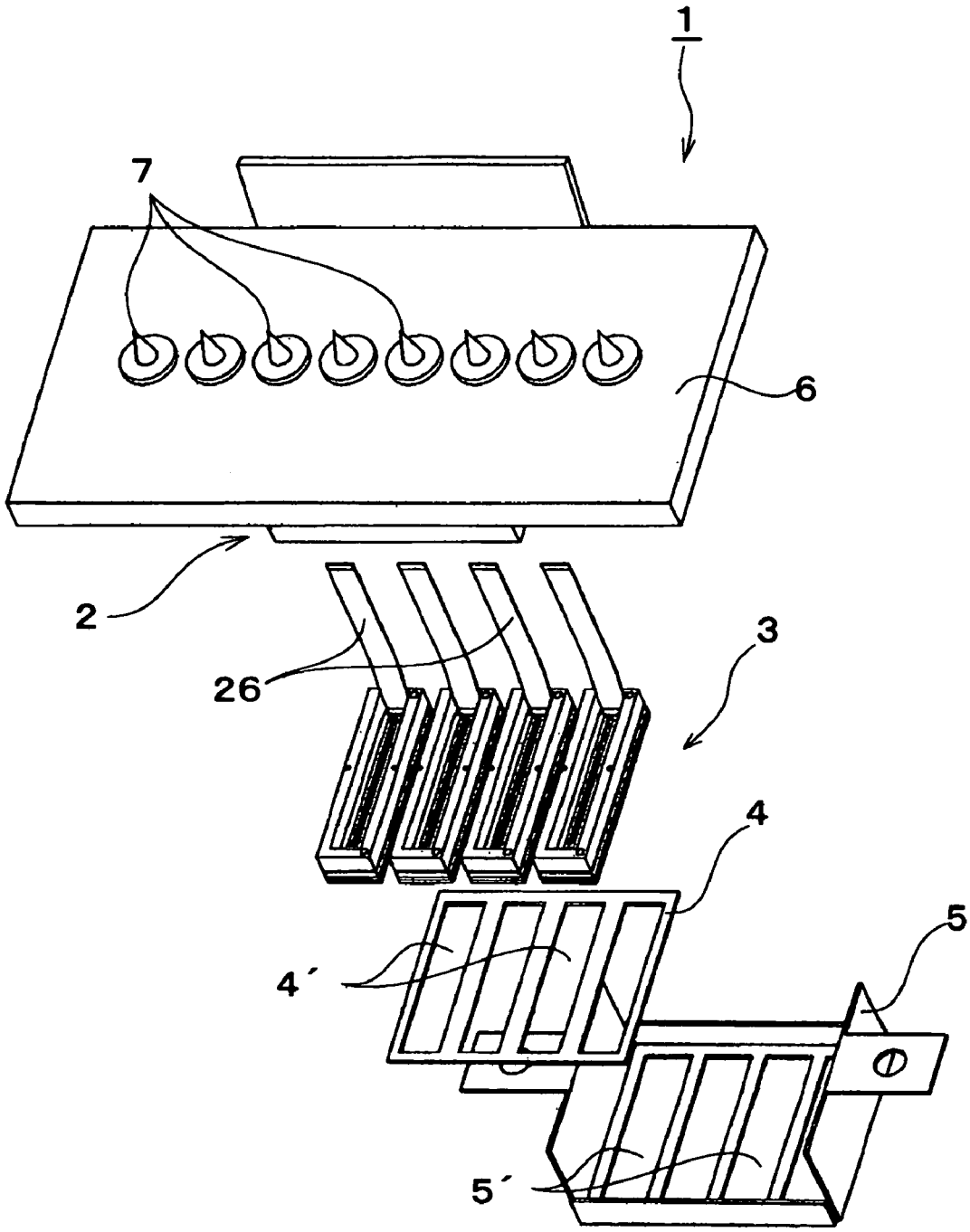
FIG. 1 is a perspective view for explaining the structure of a recording head.

FIG. 1 is an exploded perspective view showing the structure of a recording head 1 of this embodiment. The recording head 1 in this embodiment is generally composed of a base unit 2, a plurality of head units 3, a head unit fixing plate 4 and a head cover 5.

The base unit 2 is a box shaped member for accommodating the head units 2 or collective passages (not shown in the drawing) therein. A pin holder 6 is formed on an upper surface side of the base unit 2. The pin holder 6 is a plate shaped member for attaching ink supply pins 7. In this embodiment, a total of the eight ink supply pins 7 are arranged on the pin holder 6 in a transverse direction (a main scanning direction of the head) correspondingly to the colors of inks of ink cartridges. The ink supply pin 7 is a hollow pin shaped member inserted into the ink cartridge to introduce the ink stored in the ink cartridge to the head unit 3 side from an introducing hole (not illustrated) opened at its end part through the collective passage in the base unit 2.

Further, in a bottom surface side of the base unit 2, four head units 3 are transversely positioned in the main scanning direction, connected to the head unit fixing plate 4 having four opening parts 4' respectively corresponding to the head units 3 and fixed by the metallic head cover 5 on which four opening parts 5' similarly corresponding to the head units 3 are opened. Nozzle openings 14 of nozzle forming base plates 9 in the head units 3 respectively face the opening parts 4' and 5' of the head unit fixing plate 4 and the head cover 5.

Figure 2:
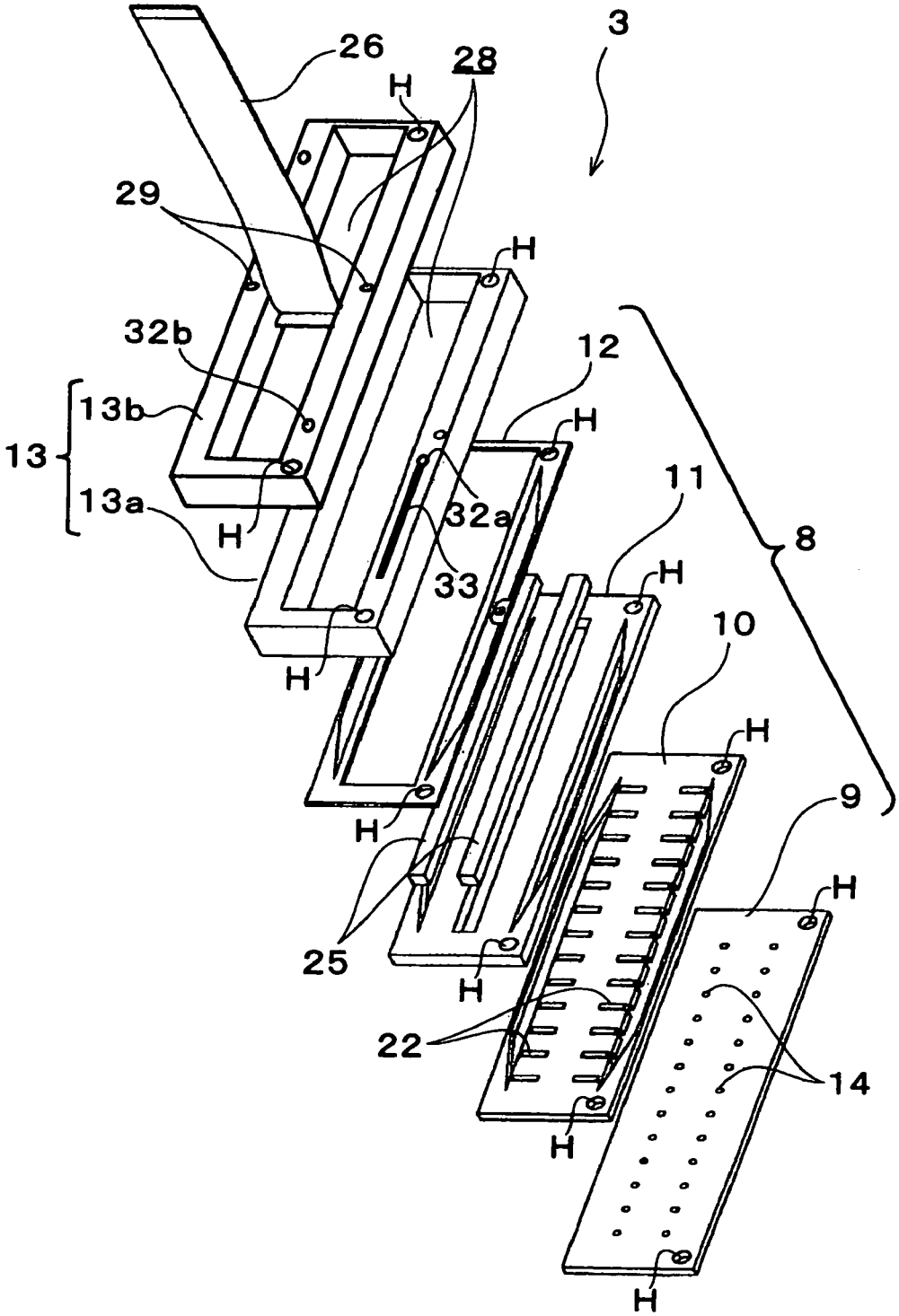
FIG. 2 is an exploded perspective view for explaining the structure of a head unit.
Figure 3:
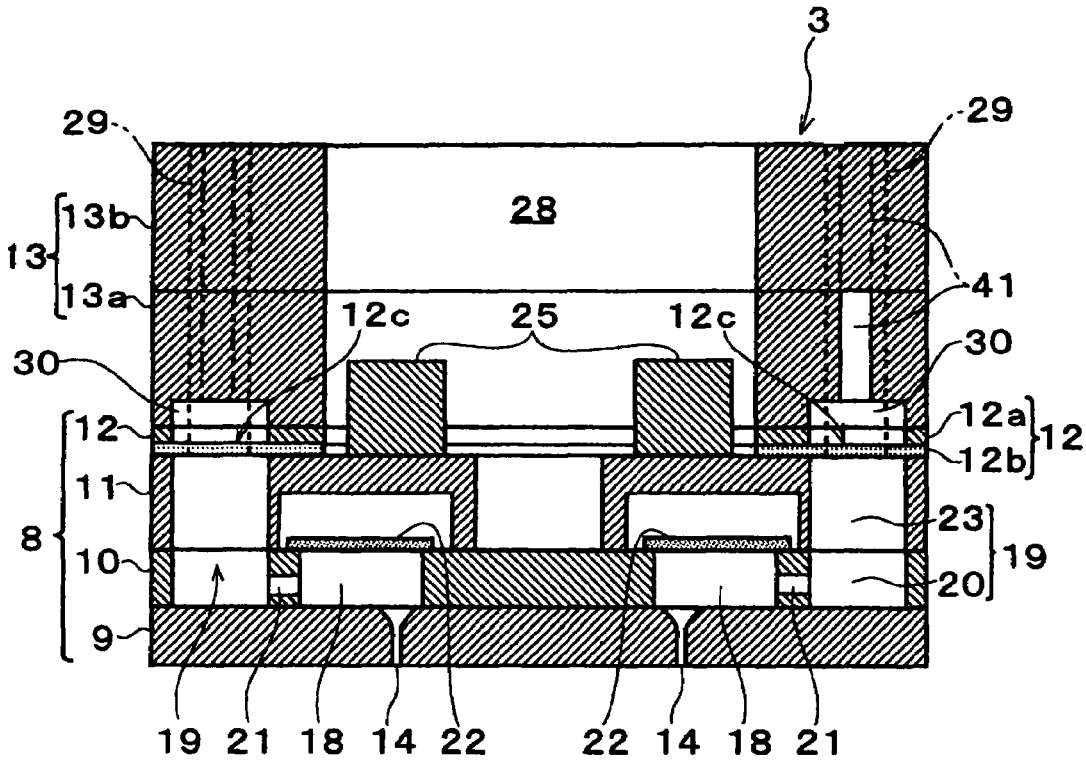
FIG. 3 is a sectional view for explaining the structure of the head unit.

FIG. 2 is an exploded perspective view showing the structure of the head unit 3 in this embodiment. FIG. 3 is a sectional view in the direction of short length of the head unit 3. For the purpose of convenience, the direction in which members respectively forming the head unit 3 (head unit forming members) are laminated is described as a vertical direction. The head unit 3 generally has a below-described structure. In the head unit 3, a cavity unit 8, having a nozzle forming base plate 9, a pressure chamber forming base plate 10, a reservoir forming base plate 11 and a compliance base plate 12 (corresponding to a plate in the present invention), piezoelectric elements 22 and drive ICs 25 are laminated and the laminated body is attached to a unit case 13. The obtained structure corresponds to a head main body in the present invention.

As shown in FIG. 2, in the head unit forming members, insert holes H that can be inserted into reference pins (not shown in the drawing) provided in the base unit 2 side are respectively opened at two positions corresponding to the reference pins. Then, the members are respectively positioned at the relative positions and fixed to the base unit 2 by respectively inserting the reference pins into the insert holes H.

The nozzle forming base plate 9 is a plate made of stainless steel on which the plurality of nozzle openings 14 are opened at a pitch corresponding to a dot forming density. On the nozzle forming base plate 9 in this embodiment, two nozzle rows are formed by arranging 360 nozzle openings 14 at a pitch of 360 dpi. The pressure chamber forming base plate 10 is formed with a silicon mono-crystal base plate (silicon wafer) in this embodiment. The surface of the base plate is subjected to an anisotropic etching process to form a plurality of pressure chambers 18 partitioned by a plurality of partition walls respectively correspondingly to the nozzle openings 14. Further, in the pressure chamber forming base plate 10, communicating space parts 20 are formed for partitioning a part of reservoirs 19 as ink chambers (common liquid chambers) respectively common to the pressure chambers 18. The communicating space part 20 communicates with each pressure chamber 18 through an ink supply passage 21.

On the upper surface (a surface opposite to the nozzle forming base plate 9 side) of the pressure chamber forming base pate 10, the piezoelectric element 22 (corresponding to a pressure generating source in the present invention) formed by sequentially laminating a lower electrode film, a piezoelectric body layer made of lead zirconic titanate (PZT) and an upper electrode film (all of them are not illustrated) is provided for each pressure chamber 18. This piezoelectric element 22 is what is called a piezoelectric element of a bending mode and formed so as to cover the upper part of the pressure chamber 18 therewith.

Further, on the pressure chamber forming base plate 10, the reservoir forming base plate 11 is arranged that has reservoir parts 23 passing through in the direction of thickness of the base plate. The reservoir forming base plate 11 is formed by using the silicon mono-crystal base plate like the pressure chamber forming base plate 10. Further, the reservoir parts 23 in the reservoir forming base plate 11 communicate with the communicating space parts 20 to partition the reservoirs 19. Ink passages from the reservoirs. 19 to the nozzle openings 14 through the ink supply passages 21 and the pressure chambers 18 correspond to liquid passages in the present invention. Further, the nozzle forming base plate 9, the reservoir forming base plate 11 and the pressure chamber forming base plate 10 in this embodiment form a passage forming base plate in the present invention.

On the upper surface (a surface opposite to the pressure chamber forming base plate 10) of the reservoir forming base plate 11, the drive ICs 25 are provided for respectively driving the piezoelectric elements 22. Terminals of the drive ICs 25 are respectively connected to lead-out wires from the individual electrodes of the piezoelectric elements 22 through bonding wires not shown in the drawing. Then, the terminals of the drive ICs 25 are respectively electrically connected to a printer controller (not shown in the drawing) of a printer main body side through wiring members 26 such as a TCP (tape carrier package). Various kinds of signals such as driving signals are supplied from the printer controller side through the wiring members 26.

Further, on the upper surface side of the reservoir forming base plate 11, the compliance base plate 12 is arranged that functions as the plate in the present invention. The compliance base plate 12 is formed with a compound plate material obtained by laminating a PPS (polyphenylene sulfide) resin film as an elastic thin film part 12*b* on the surface of a metallic support plate 12*a* such as stainless steel. On the compliance base plate 12, compliance parts 12*c* are provided for joining the opening surfaces of the reservoirs 19. The compliance parts 12*c* are composed only of the elastic thin film parts 12*b* by removing the support plates 12*a* of areas opposed to the opening surfaces of the reservoirs 19 by, for instance, an etching process. The compliance parts 12*c* functions as dampers for mitigating (absorbing) the variation of pressure in the ink in the reservoirs 19 (the ink passage) during driving the piezoelectric elements 22. In other words, the compliance parts 12*c* in the compliance base plate 12 are parts to which the variation of pressure in the ink passages is positively transmitted upon driving the piezoelectric elements 22.

The elastic thin film part 12*b* is not limited to the PPS resin film and other resin films or metallic thin films may be employed.

Figure 4:
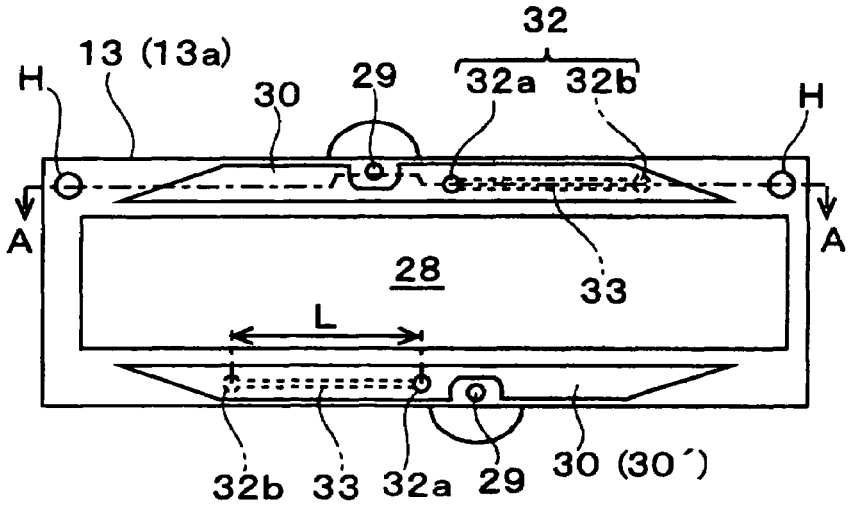
FIG. 4 is a plan view of a unit case viewed from a lower surface side.
Figure 5:
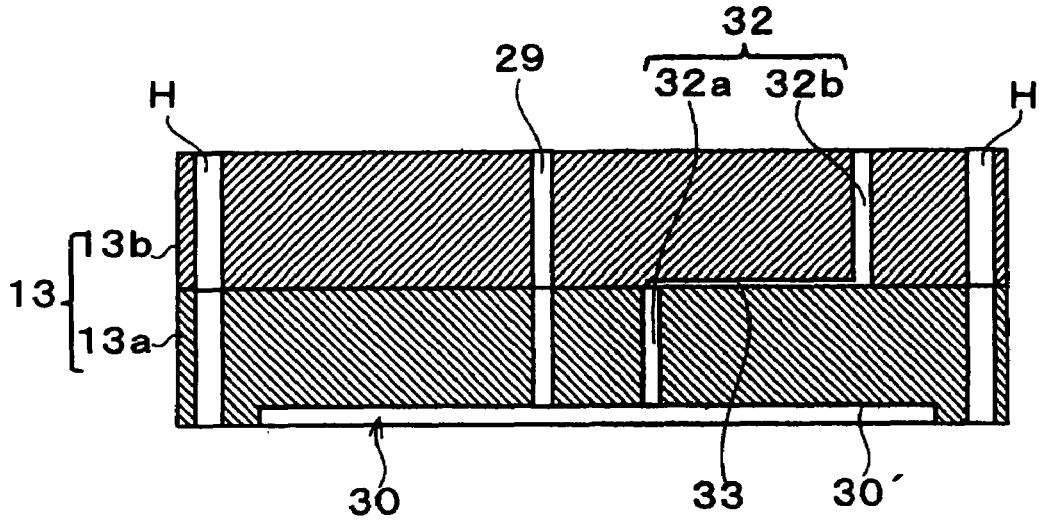
FIG. 5 is a sectional view taken along a line V-V in FIG. 4.

FIG. 4 is a plan view of the unit case 13 viewed from a lower surface side (a connecting surface side to the cavity unit 8). FIG. 5 is a sectional view taken along a line V-V in FIG. 4. This unit case 13 corresponds to one kind of a case member in the present invention and is formed by laminating a plurality of case forming members. The unit case 13 in this embodiment includes two case forming members having a first case forming member 13*a* with a lower surface connected to the cavity unit 8 (specifically, the support plate 12*a* of the compliance base plate 12) and a second case forming member 13*b* connected to the upper surface of the first case forming member 13*a*. The case forming members 13*a* and 13*b* respectively have in their centers space parts 28 passing through in the direction of thickness and are respectively formed with a synthetic resin such as a thermoplastic resin in the forms of frames long in the direction of the nozzle rows. The space parts 28 are provided so as to accommodate the drive ICs 25 provided on the reservoir forming base plate 11. The wiring members 26 are inserted into the space parts 28 and connected to the drive ICs 25.

In the case forming members 13*a* and 13*b*, two ink introducing paths 29 that communicate with the reservoirs 19 to supply the ink from the ink supply pins 7 to the reservoir 19 side pass through in the direction of thickness (the direction in which the case forming members are laminated). The ink introducing paths 20 consecutively pass through while the case forming members 13*a* and 13*b* are laminated and communicate with the reservoirs 19 under a state that the unit case 13 is connected to the cavity unit 8.

In areas (areas corresponding to the compliance parts 12*c*) corresponding to the opening surfaces of the reservoirs 19 in the connecting surface (lower surface) of the first case forming member 13*a* to the cavity unit 8, relief recessed parts 30 are formed that are provided so as to be recessed in the interiors in the direction of thickness. The relief recessed part 30 has substantially the same form and size as those of the opening part of the reservoir 19 in a plan view. A quantity of recess (an interior) of the recessed part is set such a degree as to permit the bending deformation of the elastic thin film part 12*b* due to the variation of pressure of the ink in the ink passage. More particularly, the quantity of recess is set such a dimension as not to prevent the bending deformation of the elastic thin film part 12*b* toward the relief recessed part 30 side when the pressure of the ink in the ink passage reaches the highest level. That is, the relief recessed part 30 is provided so as not to prevent the variation of pressure from being mitigated by the compliance part 12*c*.

In the case forming members 13*a* and 13*b*, atmosphere opening passages 32 (32*a*, 32*b*) through which the relief recessed parts 30 communicate with an external part of the head are respectively opened so as to pass through in the direction of thickness of the case forming members. The atmosphere opening passages 32 are passages for discharging air in the relief recessed parts 30 outside the head or introducing outside air to the relief recessed parts 30 to maintain air pressure in the relief recessed parts 30 to atmospheric pressure in accordance with the operations (the deformation of the elastic thin film part 12*b*) of the compliance parts 12*c*. When the relief recessed parts 30 are formed, a function for mitigating the variation of pressure by the compliance parts 12*c* can be more assuredly ensured.

One end of the atmosphere opening passage 32*a* provided in the first case forming member 13*a* is opened to a connecting surface (an upper surface) to the second case forming member 13*b*. Further, the other end is opened to a substantially center of an interior surface 30' of the relief recessed part 30 and communicates with the relief recessed part 30. Accordingly, the opening part of the atmosphere opening passage 32*a* to the compliance part 12*c* side is not closed by the operation of the compliance part 12*c* and the air in the relief recessed part 30 can be assuredly discharged outside or the outside air can be introduced into the relief recessed part 30 to maintain the air pressure in the relief recessed part 30 to the atmospheric pressure. Further, the atmosphere opening passage 32*b* in the second case forming member 13*b* whose position in the direction of the nozzle rows (a longitudinal direction of the recessed part 30) is located nearer to the outer part of the case than a position corresponding to the atmosphere opening passage 32*a*. One end of the passage 32*b* is opened to a lower surface (a connecting surface to the first case forming member 13*a*) of the second case forming member 13*b* and the other end is opened to the upper surface of the second case forming member 13*b* and communicates with atmospheric air.

On a boundary surface between the case forming members 13*a* and 13*b*, a control passage 33 is formed whose passage resistance is made to be higher than that of the atmosphere opening passages 32. The control passage 33 is an elongated groove shaped passage extended from a position corresponding to one end of the atmosphere opening passage 32*b* to a position corresponding to the other end of the atmosphere opening passage 32*a* on the lower surface of the second case forming member 13*b*. The control passage is provided to allow the atmosphere opening passages 32*a* and 32*b* of the case forming members 13*a* and 13*b* to communicate with each other under a state that the case forming members are laminated. That is, the atmosphere opening passages 32*a* and 32*b* communicate consecutively through the control passage 33 interposed between them while the case forming members are laminated, communicate with the relief recessed part 30, and are opened to atmospheric air so as to release the variation of the pressure of the ink in the ink passage transmitted to the compliance base plate 12 (the compliance part 12*c*).

The sectional area (internal dimension) of the passage of each of the atmosphere opening passages 32*a* and 32*b* is set to be larger than the sectional area of the passage of the control passage 33 so that it is sufficient for the air in the relief recessed part 30 to be smoothly discharged or outside air to be smoothly introduced into the relief recessed part in accordance with the operation of the compliance part 12*c*. The sectional areas of the atmosphere opening passages 32*a* and 32*b* are made to be large, so that when a connecting unit having a fluidity such as a silicon type adhesive agent is used for connecting the case unit 13 to the cavity unit 8, if the adhesive agent should enter the atmosphere opening passages 32, the atmosphere opening passages 32 could be restrained from being completely closed by the adhesive agent.

On the other hand, the sectional area or the length (total extension) of the control passage 33 is specified on the basis of the relation to its passage resistance. The control passage 33 serves to suppress, owing to its passage resistance, a quantity of passage or transmission of the ink (specifically, a solvent of the ink) passing through the elastic thin film part 12*b* as steam from the reservoir 19. In this embodiment, the passage resistance is set so that steam transmitting characteristics in the control passage 33 are lower than the steam transmittance of the elastic thin film part 12*b*. Here, assuming that a steam density of an inlet of the control passage is D1, a steam density of an outlet of the control passage is D2 and the passage resistance is R, a quantity of steam Q flowing in the control passage 33 per unit time is obtained from the following formula (1).

$$Q=(D1-D2)/R \quad (1)$$

Here, R=L/(c×S) (L: length (total extension) of the control passage 33, c: diffusion coefficient S: sectional area of control passage).

As can be understood from the above-described formula (1), when the passage resistance R of the control passage 33 is increased, the quantity of steam Q flowing in the control passage 33 can be suppressed. The length L or the sectional area of the passage of the control passage 33 is suitably set, so that the passage resistance R by which the above-described characteristics can be obtained can be applied to the control passage 33. Accordingly, the control passage 33 is provided in the case unit 13 under a state that the atmosphere opening passages 32*a* and 32*b* communicate with each other through the control passage. Thus, the ink (solvent) in the reservoir 19 can be restrained from being discharged outside the head as steam through the atmosphere opening passages 32. As a result, even when a state that the recording head 1 is not used is continuously kept for a long period of time, the rise of the viscosity of the ink in the ink passage can be suppressed as much as possible.

Further, since the control passage is provided in the unit case 13 formed by laminating a plurality of case forming members 13*a* and 13*b*, the length L or the sectional area S of the control passage, especially the length is hardly restricted by the form of the ink passage such as the reservoir 19 or the size of the recording head 1 (it is sufficient only to avoid the ink introducing paths 29) and can be set to obtain the passage resistance R capable of suppressing the diffusion of the steam. That is, the control passage can meet the miniaturization of the recording head 1.

Further, since the atmosphere opening passages 32 are respectively individually formed in the case forming members 13*a* and 13*b* so as to consecutively communicate with each other while the case forming members are laminated, the length itself of the individual passages can be shortened. Thus, the atmosphere opening passages 32*a* and 32*b* can be formed with high accuracy. That is, the length of the individual passages is reduced, so that, for instance when the unit case 13 (the case forming members 13*a* and 13*b*) is formed by using a synthetic resin, the generation of bending or breakage of a pin for forming space parts as the passages can be suppressed. Further, when the unit case 13 is formed by a pressing process to a metallic material such as stainless steel, the bending or buckling of a punch can be suppressed. As a result, the atmosphere opening passages 32*a* and 32*b* can be formed with good accuracy.

In this embodiment, since the control passage 33 is provided on the boundary surface between the case forming members, that is, the control passage is formed at a position separate from a boundary surface (the connecting surface) of the case unit 13 and the cavity unit 8, even when an adhesive agent having a high fluidity is used as a connecting unit for connecting the case unit 13 to the cavity unit 8, there is no fear that the adhesive agent enters the control passage 33. Accordingly, the number of choices of the connecting unit for connecting the case unit 13 to the cavity unit 8 can be increased. For instance, in this embodiment, a silicon type adhesive agent is used to connect the cavity unit 8 to the unit case 13. The silicon type adhesive agent exhibits a flexibility even under a state that the members are respectively connected together, and can absorb and mitigate a stress generated in the connecting part by the flexibility of the silicon type adhesive agent. Thus, a distortion or separation between the members can be effectively prevented.

In this embodiment, since both the case forming members 13*a* and 13*b* are formed with the same synthetic resin, there is substantially no difference in coefficient of thermal expansion between them. Therefore, the case forming members 13*a* and 13*b* are preferably bonded together by an adhesion by transferring, for instance, an epoxy based sheet type adhesive agent. It is to be understood that the case forming members 13*a* and 13*b* may be connected together by using the silicon type adhesive agent. Further, when both the case forming members 13*a* and 13*b* are formed with metal, a coefficient of linear expansion of metal is lower than that of a resin and there is no care about a swelling. Accordingly, for instance, even when an environment such as humidity changes, the size of the control passage 33 formed in the boundary part between the case forming members 13*a* and 13*b* can be prevented from unnecessarily changing. Further, since the metallic case members 13*a* and 13*b* have a rigidity higher than that when the case members are formed with the resin, for instance, when a force is exerted that aims to bend the entire part of the head upon connecting the nozzle plate to the head main body, even if the thickness of the case forming members 13*a* and 13*b* is not so large, the curvature of the entire part of the head can be suppressed. Consequently, the size of the passage can be ensured that is necessary for exhibiting a function of the control passage 33 for suppressing the transmission of the steam.

As described above, in the recording head 1, the steam is restrained from flowing out to the atmospheric air by the control passage 33 provided in the unit case 13. Accordingly, even when the recording head 1 is not continuously used for a long period of time, the rise of the viscosity of the ink in the ink passage can be suppressed as much as possible. Thus, the insufficient discharge of ink droplets resulting from the increased viscosity of the ink can be reduced.

The present invention is not limited to the above-described first embodiment and various modifications may be made in accordance with the description of claims.

Figure 6:
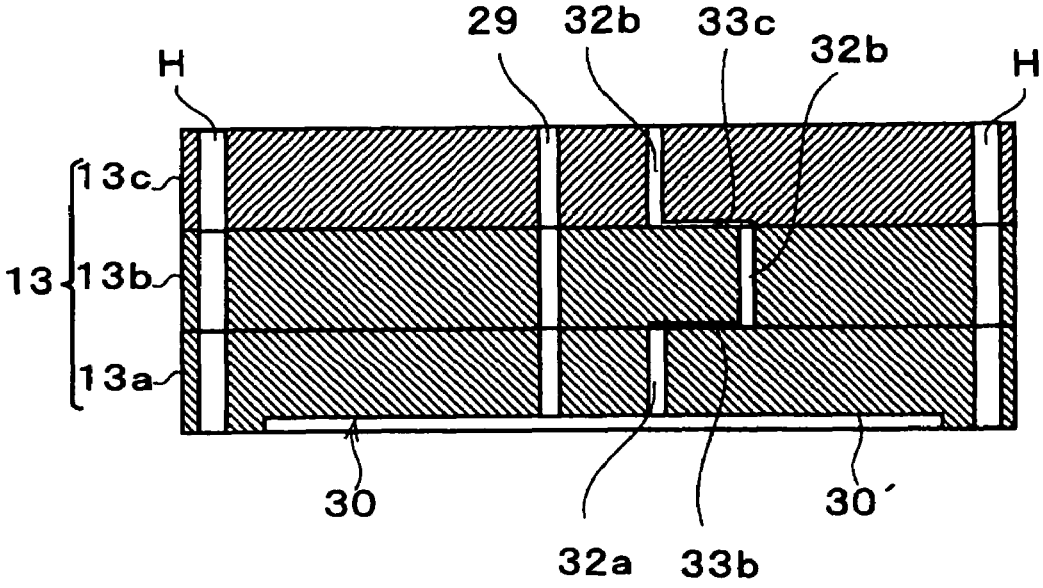
FIG. 6 is a sectional view for explaining the structure of a unit case in a second embodiment.

For instance, as for the unit case 13, in the first embodiment, an example is shown tat is formed by laminating the two case forming members 13*a* and 13*b*. However, the present invention is not limited thereto. As shown in FIG. 6, a unit case 13 may be formed with three or more case forming members as in a second embodiment. In the embodiment shown in FIG. 6, the unit case 13 is composed of three case forming members 13*a*, 13*b* and 13*c*.

Further, in the first embodiment, an example is shown in which only one control passage 33 is provided in the unit case 13. However, as in the second embodiment shown in FIG. 6, a plurality of control passages 33 may be provided in the unit case 13. In the second embodiment, control passages 33*b* and 33*c* are respectively formed on a boundary surface between the case forming members 13*a* and 13*b* (a lower surface of the second case forming member 13*b*) and a boundary surface between the case forming members 13*b* and 13*c* (a lower surface of the third case forming member 13*c*). In such a way, individual passages can be more shortened and more accurately formed.

Figure 7:
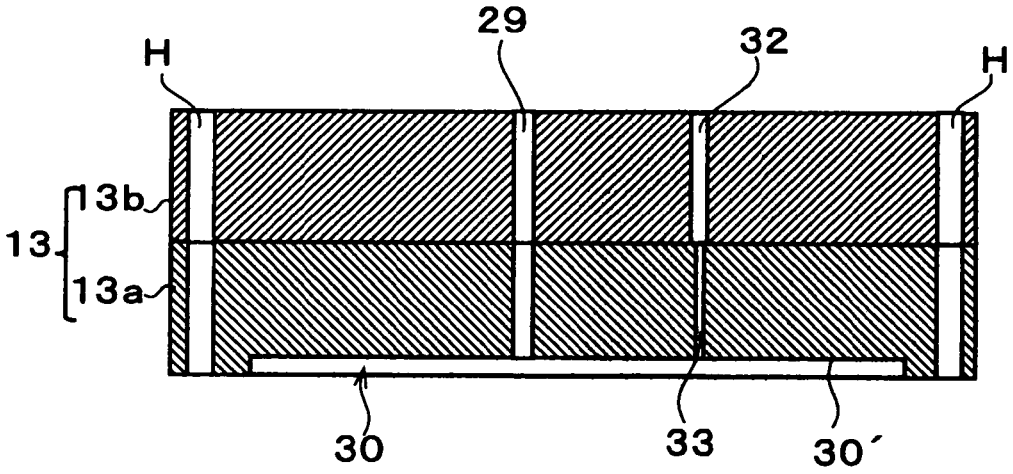
FIG. 7 is a sectional view for explaining the structure of a unit case in a third embodiment.

Further, in the first embodiment, an example is shown in which the control passage 33 is provided on the boundary surface between the case forming members 13*a* and 13*b*. However, the present invention is not limited thereto. For instance, as in a third embodiment shown in FIG. 7, a control passage 33 may be provided so as to pass through in the direction of thickness of a case forming member. In this embodiment, one end of the control passage 33 of a first case forming member 13*a* is opened on an upper surface of the first case forming member 13*a* and communicates with an atmosphere opening passage 32 of a second case forming member 13*b*. The other end is opened to an interior surface 30' of a relief recessed part 30 to communicate with the relief recessed part 30.

Briefly, the control passage 33 may be formed in at least one of the case forming members forming a unit case 13, at least one of the atmosphere opening passage 32 and the control passage 33 may be formed in each of the case forming members and the passages 32 and 33 may consecutively communicate with each other to be opened to atmospheric air under a state that the case forming members are laminated.

Further, in the first embodiment, an example is shown that the unit case 13 (the case forming members 13*a* and 13*b*) is formed by molding with a synthetic resin. However, the present invention is not limited thereto, and, for instance, a unit case 13 (case forming members 13*a* and 13*b*) may be formed by a pressing process to a metallic material such as stainless steel. According to this structure, a coefficient of thermal expansion can be set to that of the support plate 12*a* of the compliance base plate 12 similarly formed with the metal such as the stainless steel. As a result, a distortion or separation between the members due to the change of temperature or humidity can be prevented.

Further, in the first embodiment, examples are shown that the case forming members 13*a* and 13*b* are respectively connected together by the silicon type adhesive agent or the epoxy based sheet type adhesive agent. However, the present invention is not limited thereto. As in a fourth embodiment shown in FIG. 8, a structure may be employed in which case forming members 13*a* and 13*b* are connected together without using an adhesive agent. When this structure is used, since an adhesive agent does not enter a control passage 33 provided between the case forming members so that atmosphere opening passages communicate with each other through the control passage, even when the control passage is provided in a narrow range of the case forming member, the control passage 33 can sufficiently exhibit a function for diffusing steam. Thus, liquid in a common liquid chamber can be restrained from being discharged as steam outside the head through the atmosphere opening passages.

Figure 8:
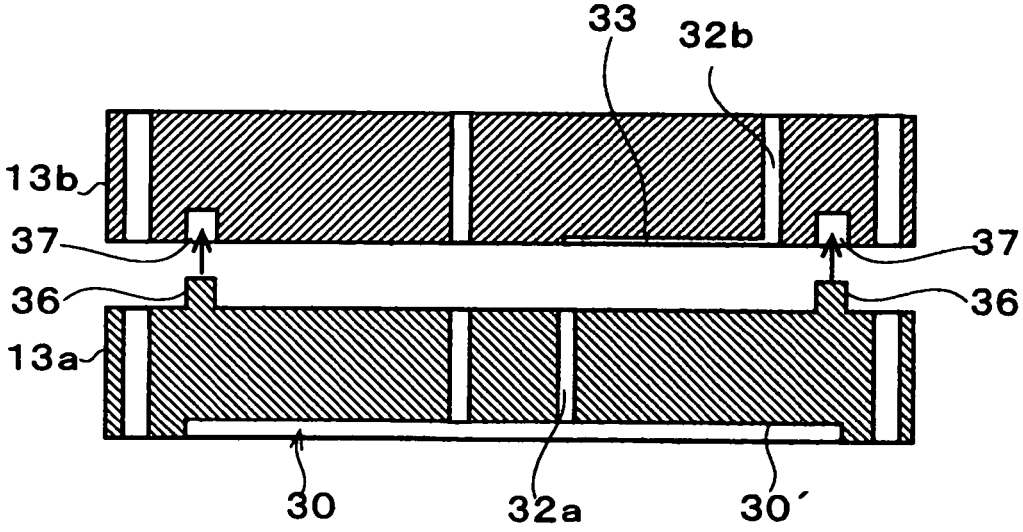
FIG. 8 is a sectional view for explaining the structure of a unit case in a fourth embodiment.

In the embodiment shown in FIG. 8, bosses 36 protrude on the upper surface of one first case forming member 13*a* and boss receiving parts 37 into which the bosses 36 of the first case forming member 13*a* side are inserted are formed on the lower surface of the other second case forming member 13*b*. The dimensions of the boss 36 and the boss receiving part 37 are respectively set so as to achieve what is called a tight fit. The bosses 36 of the first case forming member 13*a* are inserted into the boss receiving parts 37 of the second case forming member 13*b* so that the case forming members 13*a* and 13*b* are respectively connected together.

As described above, as the liquid ejection head, the recording head 1 is explained as an example. However, the present invention may be applied to other liquid ejection heads. For instance, the present invention may be applied to a color material ejection head used for producing a color filter of a liquid crystal display or the like, an electrode material ejection head used for forming an electrode of an organic EL (Electro Luminescence), an FED (face light emitting display) or the like, a biological organic material ejection head used for producing a bio-chip (a biochemical element), etc.

What is claimed is:

1. A liquid ejection head comprising:

a head main body including:

a cavity unit including a passage forming base plate forming a liquid passage from a common liquid chamber to a nozzle opening via a pressure chamber; and a pressure generating source generating a change of pressure of liquid in the pressure chamber to eject the liquid in the pressure chamber as a liquid droplet from the nozzle opening; and a case member to which the head main body is attached and which includes: a first member provided with a first atmosphere opening passage; and a second member laminated on the first member and provided with a second atmosphere opening passage, wherein the first and second atmosphere opening passages communicate with each other under the laminated state and are opened to atmosphere.

2. The liquid ejection head according to claim 1, wherein the first and second atmosphere opening passages pass through the first and second members respectively in a direction in which the first and second members are laminated, and the case member comprises a control passage having a higher passage resistance than those of the first and second atmosphere opening passages, the control passage being provided at a boundary between the first and second members and communicating the first atmosphere opening passage with the second atmosphere opening passage.

3. The liquid ejection head according to claim 2, wherein a sectional area of each of the first and second atmosphere opening passages is larger than that of the control passage.

4. The liquid ejection head according to claim 2, wherein the control passage is extended in a direction in which a plurality of the nozzle openings are arrayed.

5. The liquid ejection head according to claim 2, wherein the case member further comprises a third member laminated on the second member and provided with a third atmosphere opening passage communicating with the first and second atmosphere opening passages.

6. The liquid ejection head according to claim 5, wherein the third atmosphere opening passage passes through the third member in the direction, and the case member further comprises a control passage having a higher passage resistance than those of the first to third atmosphere opening passages, the control passage being provided at a boundary between the second and third members and communicating the second atmosphere opening passage with the third atmosphere opening passage.

7. The liquid ejection head according to claim 1, wherein the cavity unit further comprises a plate joining an opening surface of the common chamber, the plate including:

an elastic thin film part having an elasticity; and a support plate supporting the elastic thin film part and having an opening part, the elastic thin film part being opposed to the opening surface of the common liquid chamber and located between the opening part of the support plate and the opening surface of the common liquid chamber, and wherein the case member connected to the cavity unit has a relief recessed part opposed to the elastic thin film through the opening part, and the first atmosphere opening passage communicates with the relief recessed part.

8. The liquid ejection head according to claim 7, wherein the elastic thin film part is made from a polyphenylene sulfide.

9. The liquid ejection head according to 1, wherein the first and second members are connected with each other by an adhesion.

10. The liquid ejection head according to claim 1, wherein the first member has a boss on a surface connected to the second member, and the second member has a boss receiving part into which the boss is inserted.

11. The liquid ejection head according to claim 1, wherein the first atmosphere opening passage has a higher passage resistance than that of the second atmosphere opening passage.

12. The liquid ejection head according to claim 11, wherein the first and second atmosphere opening passages are connected with each other directly in a direction in which the first and second members are laminated.

13. A liquid ejection head comprising:

a head main body including:

a cavity unit including a passage forming base plate forming a liquid passage from a common liquid chamber to a nozzle opening via a pressure chamber; and a pressure generating source pressuring liquid stored in the pressure chamber to eject the liquid from the nozzle opening; and a case member to which the head main body is attached and which includes: a first member provided with a atmosphere opening passage communicating with atmosphere; and a second member laminated on the first member and provided with a control passage having a higher passage resistance than that of the atmosphere opening passage, wherein the atmosphere opening passage and the control passage communicate with each other;

wherein the cavity unit further comprises a plate joining an opening surface of the common chamber, the plate including:

an elastic thin film part having an elasticity; and a support plate supporting the elastic thin film part and having an opening part, the elastic thin film part being opposed to the opening surface of the common liquid chamber and located between the opening part of the support plate and the opening surface of the common liquid chamber, and wherein the case member connected to the cavity unit has a relief recessed part opposed to the elastic thin film through the opening part, and the first atmosphere opening passage communicates with the relief recessed part.

14. The liquid ejection head according to claim 13, wherein the elastic thin film part is made from a polyphenylene sulfide.

15. A liquid ejection head comprising:

a head main body including:

a cavity unit including a passage forming base plate forming a liquid passage from a common liquid chamber to a nozzle opening via a pressure chamber; and a pressure generating source pressuring liquid stored in the pressure chamber to eject the liquid from the nozzle opening; and a case member to which the head main body is attached and which includes: a first member provided with a atmosphere opening passage communicating with atmosphere; and a second member laminated on the first member and provided with a control passage having a higher passage resistance than that of the atmosphere opening passage, wherein the atmosphere opening passage and the control passage communicate with each other;

wherein the first member has a boss on a surface connected to the second member, and wherein the second member has a boss receiving part into which the boss is inserted.

* * * * *